US007137737B2

(12) United States Patent
Schneider

(10) Patent No.: US 7,137,737 B2
(45) Date of Patent: Nov. 21, 2006

(54) PULL-STRIP BAG WITH ADHESIVE TAPE

(75) Inventor: Jakob Schneider, Niederkassel (DE)

(73) Assignee: Lemo Maschinenbau GmbH, Niederkassel-Mondorf (DE)

( * ) Notice: Subject to any disclaimer, the term of this patent is extended or adjusted under 35 U.S.C. 154(b) by 524 days.

(21) Appl. No.: 10/480,619

(22) PCT Filed: Apr. 2, 2003

(86) PCT No.: PCT/EP03/03409

§ 371 (c)(1),
(2), (4) Date: Dec. 10, 2003

(87) PCT Pub. No.: WO03/091122

PCT Pub. Date: Nov. 6, 2003

(65) Prior Publication Data

US 2005/0123219 A1 Jun. 9, 2005

(30) Foreign Application Priority Data

Apr. 26, 2002 (DE) ..... 102 18 720

(51) Int. Cl.
*B65D 33/28* (2006.01)

(52) U.S. Cl. ..... 383/75; 383/72

(58) Field of Classification Search ..... 383/75, 383/72

See application file for complete search history.

(56) References Cited

U.S. PATENT DOCUMENTS 4,813,794 A 3/1989 Herrington
4,832,507 A * 5/1989 Herrington ..... 383/74
4,842,421 A * 6/1989 Bullard et al. ..... 383/61.4
5,716,137 A 2/1998 Meyer
6,059,458 A 5/2000 Belias et al.
6,926,141 B1 * 8/2005 Montler ..... 206/320

FOREIGN PATENT DOCUMENTS

DE 38 21 905 2/1990
DE 101 51 843 5/2003
GB 2 231 027 A * 11/1990 ..... 383/75

* cited by examiner

*Primary Examiner*—Jes F. Pascua
(74) *Attorney, Agent, or Firm*—Andrew Wilford

(57) ABSTRACT

The invention relates to a thermoplastic film bag comprising a front wall (1) and a rear wall (2), which are joined to one another by lateral weld seams (3, 4) while forming a filling opening (6) and are each double-plied in the area of the filling opening (6), and comprising two pull-strips (7, 8). These pull-strips extend over the width of the bag, whereby one is inserted between both plies of the front wall (1) and of the rear wall (2) and they are welded to one another at both ends thereof. The inventive bag also comprises a grasping hole (11) that at least partially exposes the pull-strip, and a partially detachable adhesive tape (13) is placed on the inner surface of the pull-strip (7) in the area of the grasping hole (11).

6 Claims, 2 Drawing Sheets

PULL-STRIP BAG WITH ADHESIVE TAPE

This application is the National Stage of International Application No. PCT/EP03/03409, filed Apr. 2, 2003, with a priority claim to German Application No. 102-18-720.7, filed Apr. 26, 2002.

FIELD OF THE INVENTION

The invention relates to a bag made of a thermoplastic synthetic-resin foil and having a front wall and a back wall that are joined together at edge seams to form a fill opening and that are each formed of two layers at the fill opening, front and back draw tapes that extend across the width of the bag between the layers of the respective front and back walls and that are fixed together at their ends, and a hand hole partially defined by the draw tapes.

STATE OF THE ART

Such a bag, which can be closed after it is filled by means of the built-in draw tape, is produced in many forms. German 3,821,905 describes a bag where a drawstring is set in a folded-over and welded seam at the fill opening and that is also fixed at the side seams. A handhold in the center of the seam exposes the drawstring.

A bag and method of making it are described in EP 0,700,835 (Translator's note: See U.S. Pat. No. 5,716,137) wherein the front and back walls are each formed by an inner foil and an outer foil extending over the entire wall area. Draw tapes extending the full width of the bag are provided at the fill opening between the two foils and are joined together at their ends at side seams of the bag. Each double wall is formed centrally with a hand hole partially exposing the respective draw tape.

German patent document 101 51 843 describes a bag of a thermoplastic synthetic resin having a front wall, a back wall, and two draw tapes extending across the width of the bag, the front and back walls being punched out at the corners to expose end regions of the draw tapes that are elastically stretchable and welded together in the exposed end regions offset from the end seams.

The second set of welds of the draw tapes define a fill opening of limited size but that can be stretched open. Such an edge strip on the bag can be elastically tightened over the mouth of a trash receptacle and left there. The ends projecting past the inner welds form projecting eyes that allow the bag to be lifted by the draw tapes out of the receptacle and then sealed up.

Such a gag is mainly intended for lining a bucket-shaped receptacle, for example a trash can. With the known bag the upper edge of the bag with the draw tapes is pulled over the upper edge of the receptacles and the elastic draw tapes hold the bag in place and close it.

OBJECT OF THE INVENTION

It is therefore an object of the invention to so improve a bag of the described type that it can be made more simply and more easily fixed to a mouth of a receptacle.

This object is achieved in that a face of the draw tape carries at the hand hole an adhesive strip that can be adhered to the wall adjacent the hand hole to reduce the cross section of the fill opening.

With the provision of an adhesive strip according to the invention near the hand hole it is now possible to secure the bag more easily and more surely on a receptacle mouth.

According to one embodiment of the invention the adhesive strip is on a face of the draw tape near the hand hole and on the inside of the front wall. The draw-string bags are manufactured in rolls. To use the bag it is unwound from the roll and separated therefrom at a perforation line.

The draw-string bag is fitted inside a receptacle and the upper seam is folded down over the rim of the receptacle. Folding-down the bag seam over the holder rim ensures that the adhesive strip is freely accessible at the hand hole. The adhesive strip can have according to the invention two regions. The first region forms the adhesive patch that fixes the adhesive strip to the draw tape. The second region of the adhesive strip is provided with a separable cover that can be formed of a paper or foil strip. In order that the cover can be easily removed from the adhesive strip, it can have an extension that is folded back over the cover.

According to a further embodiment of the invention, the adhesive patch has several parts, either separate parts or parts joined at a perforation line, so that the cover can be partially removed. Preferably the cover stays on the free end of the adhesive strip. This region of the adhesive strip provided with the remaining part of the cover can be gripped to tighten the draw tape.

After removing the cover from the adhesive strip, the draw tape is tightened around the receptacle rim and fixed in place. According to the invention tightening of the draw tape is done by pulling on the grip part of the adhesive strip. After tightening, the adhesive strip can be fixed on the seam of the bag folded over the receptacle rim. This makes possible to fit the bag to receptacles of widely different diameters.

A further advantage according to the invention is obtained by the use of the adhesive strip in that, after the adhesive strip has been fixed to the seam, it can be released to take the bag out of the receptacle. Furthermore it is possible to reuse the draw tape for substantially different sizes. In addition the adhesive strip can be used to seal the draw-string bag closed.

In contrast to the above-discussed state of the art, the adhesive strip can be used with elastic and inelastic draw tapes. This represents a cost saving relative to draw tapes of elastic material, since the draw tape in a bag according to the invention can be made of the same material as the bag. A further advantage of the use of the adhesive strip is that the pull tape can be adapted to any diameter of receptacle.

With the described embodiment of a draw-string bag the adhesive strip is on the surface of the draw tape, near the hand hole, and on an inner face of the front wall. The adhesive strip can also of course be provided on the outer face, so that an inside tightening is possible by means of the draw tape.

In addition the illustrated embodiments of the draw-string bag and the arrangement of the cover, the adhesive strip can also be variously made. Thus for example the adhesive strip can be made many times longer by being multiply folded, like a zig-zag, and secured to the draw tape.

BRIEF DESCRIPTION OF THE DRAWING

A preferred embodiment of a bag according to the invention is shown in the drawing.

Therein.

EMBODIMENTS OF THE INVENTION

Figure 1:
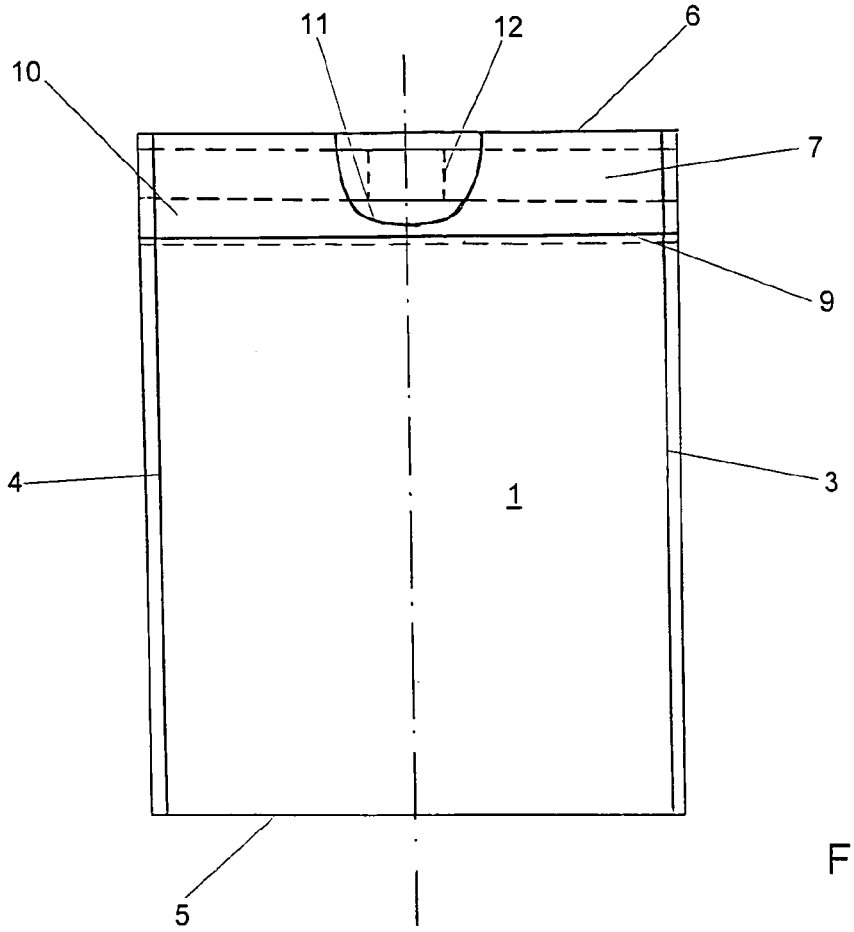
FIG. 1 is a top view of a bag.
Figure 5:
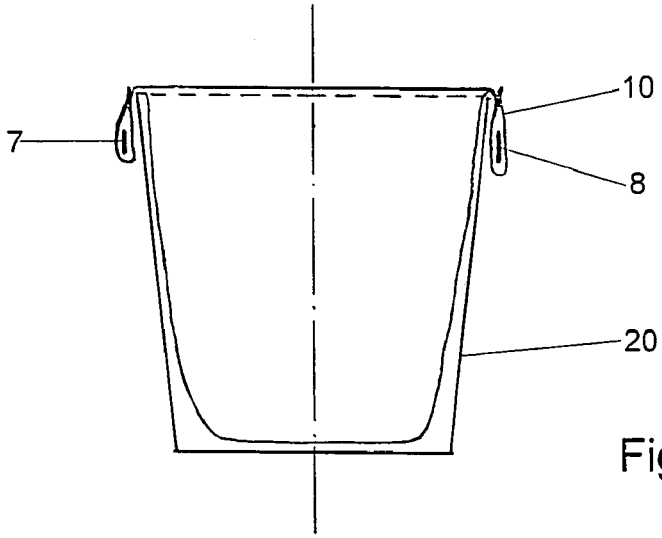
Figure 6:
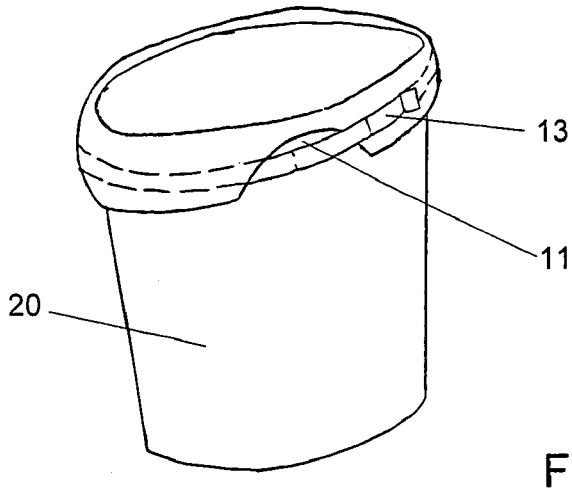

The bag shown in FIG. 1 is formed of a thermoplastic synthetic resin. It has a front wall 1 and a back wall 2 that are joined together at their edges by side seams 3 and 4. The lower end of the bag is closed by a bottom seam 5 that is produced by longitudinal welding or folding. The front wall 1 and the back wall 2 are formed at least adjacent a fill opening 6 of two layers as shown in FIG. 5.

Front and back draw tapes 7 and 8 are set between the two layers 1 of the front wall 1 and the back wall 2 at the fill opening 6. The draw tapes 7 and 8 extend the full bag width and are welded together at their ends at the seams 3 and 4 so that they form a continuous draw tape all around the opening 6 as shown in FIG. 2.

A two-layer upper region 10 of the front wall 1 defined by the seam 9 has at the center of the bag an arcuate cutout 11 at which the draw tape is exposed. In another embodiment of the invention there can also be such a cutout in the back wall 2. The cutout 11 forms a hand hole through which the draw tape 7 can be pulled. An adhesive patch is provided on the draw tape 7 at line 12.

Figure 2:
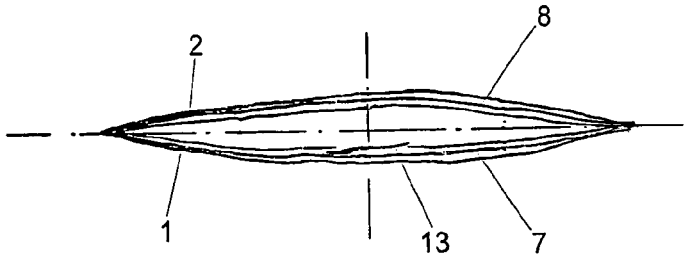
FIG. 2 is a top view of a bag.

The position of the adhesive strip 13 is also shown in FIG. 2. The adhesive patch is on an outer face 14 of the draw tape 7.

Figure 3:
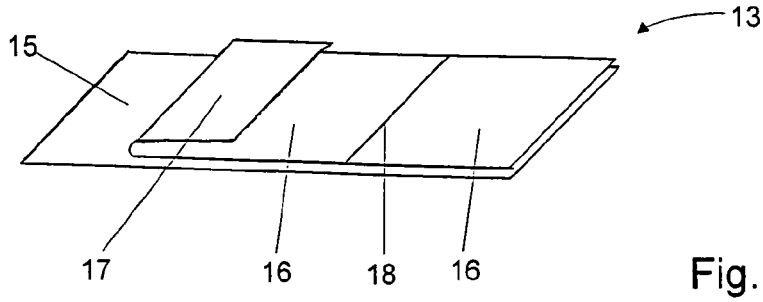
FIG. 3 is a three-dimensional view of a draw tape.

Details of the adhesive strip 13 according to the invention are shown in FIG. 3; it has two regions. The first region of the adhesive strip 13 is formed by an adhesive patch 15 which serves for sticking to the draw tape 7. A second part of the adhesive strip 13 is provided with a cover 16. The cover 16 has in this embodiment an extension that is folded back on the cover 16. The extension 17 thus serves for separating the cover 16 from the adhesive strip 13. The cover 16 can be made according to the invention in two parts or is separable at a perforation line 18. Thus only one part of the cover is separated from the adhesive patch. The remaining part of the cover on the adhesive strip serves for gripping during tightening of the draw tape.

Figure 4:
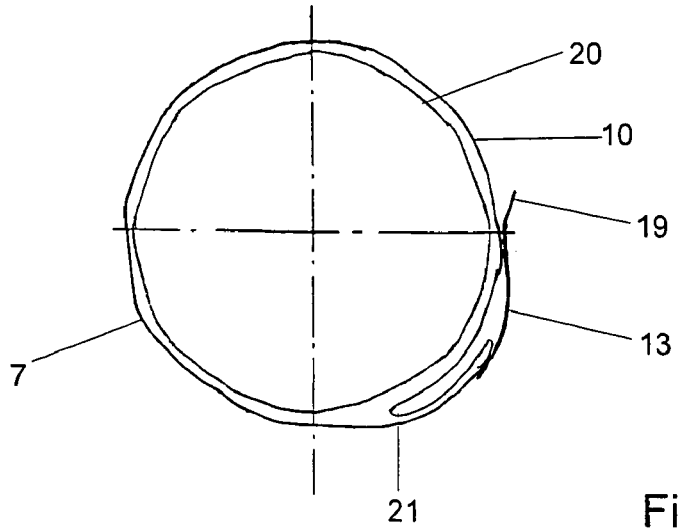
FIG. 4 is a general top view of the draw tape when tightened around a receptacle and FIG. 5 is a section through a receptacle with the draw-string bag and FIG. 6 is a three-dimensional view of a receptacle with a bag.

FIG. 4 shows a receptacle 20 and the upper region 10 of the draw-string bag tightened and fixed over the receptacle mouth. When the inelastic draw tape 7 is pulled tight it overlaps at 21 at the adhesive strip 13. The grip part 19 remains accessible so that the adhesive strip can be released later.

FIG. 5 shows the draw-string bag in a receptacle 20 before tightening of the draw tape. The upper region 10 is folded down over the receptacle mouth. The position of the draw tapes 7 and 8 at the seam or in the upper region of the draw-string bag can be seen.

FIG. 4 shows in three-dimensional view a draw-string bag set in a receptacle 20. The adhesive strip 13 is pulled out of the hand hole 11 and adhered to the upper region or seam of the drawstring bag.

The invention claimed is:

1. A bag comprising:

a front wall and a back wall having joined together side edges and together forming an end fill opening, the walls being formed of two layers at the opening, the front wall being formed at the opening with a cutout;

respective front and back draw tapes between the layers at the fill opening of the respective walls and having ends connected together at the side edges, the front tape having a portion exposed at the cutout; and an adhesive strip fixed to the front tape at the exposed portion and carrying an adhesive patch capable of sticking to the walls, whereby, when the exposed portion of the front tape is pulled, the tape tightens to restrict the opening and the patch can be adhered to one of the walls to maintain the opening restricted.

2. The bag defined in claim 1 wherein the adhesive strip is provided over the patch with a removable cover.

3. The bag defined in claim 2 wherein the cover has two parts.

4. The bag defined in claim 3 wherein the cover is formed between its parts with a perforation line.

5. The bag defined in claim 2 wherein the cover has a folded-back end portion.

6. The bag defined in claim 1 wherein the adhesive strip is secured to a surface of the front tape and to an inner face of the front wall.

* * * * *